US008888567B2

(12) United States Patent
Allen et al.

(10) Patent No.: US 8,888,567 B2
(45) Date of Patent: Nov. 18, 2014

(54) SKATE SHARPENING SQUARING DEVICE AND METHOD OF USE

(76) Inventors: Robert H. Allen, Ontario (CA); Robert H. Moon, Chatham (CA)

( * ) Notice: Subject to any disclaimer, the term of this patent is extended or adjusted under 35 U.S.C. 154(b) by 628 days.

(21) Appl. No.: 13/156,641

(22) Filed: Jun. 9, 2011

(65) Prior Publication Data

US 2012/0315832 A1 Dec. 13, 2012

(51) Int. Cl.

| | |
|---|---|
| ***B24B 3/00*** | (2006.01) |
| ***B24D 15/06*** | (2006.01) |
| ***B24B 9/04*** | (2006.01) |

(52) U.S. Cl.

CPC ..... *B24B 9/04* (2013.01)
USPC ..... 451/383; 76/83

(58) Field of Classification Search

CPC ..... B24B 3/003; B24D 15/066; G01B 5/24
USPC ..... 451/45, 365, 293, 383, 410; 76/83
See application file for complete search history.

(56) References Cited

U.S. PATENT DOCUMENTS

| | | | | |
|---|---|---|---|---|
| 3,382,582 | A * | 5/1968 | Matson | 33/535 |
| 5,345,688 | A | 9/1994 | Allen | |
| 5,547,416 | A * | 8/1996 | Timms | 451/45 |
| 5,897,248 | A | 4/1999 | Schlueter | |
| 5,897,428 | A | 4/1999 | Sakcriska | |
| 7,191,539 | B2 * | 3/2007 | Zukerman | 33/535 |
| 7,434,324 | B2 * | 10/2008 | McKenna | 33/474 |
| D603,432 | S * | 11/2009 | Wilson et al. | D15/125 |
| 7,918,035 | B1 * | 4/2011 | Jarczewski | 33/535 |

* cited by examiner

*Primary Examiner* — Robert Rose
(74) *Attorney, Agent, or Firm* — Clark & Brody

(57) ABSTRACT

A skate squaring device includes a main frame having a slot to receive a skate blade. The main frame is designed to attach to a portion of a skate sharpening fixture such that calibration lines on the main frame are perpendicular to a centerline axis of a body of the skate blade when mounted in the holder. A magnetic angle is attached to the end of the skate blade and positioned adjacent a face of the main frame having the calibration lines to determine if the skate blade edge is square.

16 Claims, 5 Drawing Sheets

SKATE SHARPENING SQUARING DEVICE AND METHOD OF USE

FIELD OF THE INVENTION

The present invention is directed to a skate squaring device, and particularly to a skate squaring device that can be used on skates with skate blade bodies having different cross sectional shapes.

BACKGROUND ART

A number of skate sharpening fixtures have been developed for skate sharpening machines. These fixtures hold the skate blade in place while a grinding wheel or the like is used to sharpen the skate blade. The orientation of the skate blade with respect to the grinding wheel is critical, and if the blade and wheel are not properly aligned, the blade will be sharpened in a not-square condition.

Prior art fixtures offer control of the blade orientation, see for example the Wissota and Blademaster fixtures, and U.S. Pat. No. 5,897,248 to Sacriska. In the Wissota "tangent finder" fixture, adjustments can be made to the height, in or out tilt, and side to side or degree of level tilt. The level of tilt is controlled by a knob wherein rotation of the knob alters the tilt of the lower blade support.

FIG. 1 shows a perspective view of an exemplary skate sharpening fixture, which is designated by the reference numeral 100. The fixture comprises an anvil base 101 which floats on a base plate 103, using springs, bolts and the like. Control knobs 105 are provided for adjusting the orientation of the anvil base 101 with respect to the base plate 103 for sharpening.

An anvil plate 107 is mounted to the anvil base 101 using block 109. The anvil plate 107 provides a surface 108 for one side of the skate blade body to rest when the skate edge is being sharpened and another surface 110. A clamp assembly 111 is also provided, which is also mounted to the anvil base 101. The clamp assembly includes a clamp 113, which is designed to be biased against the other side of the skate blade body during the sharpening operation.

The squareness of the skate blade can be checked by skate squaring devices such as that disclosed in U.S. Pat. No. 5,345,688 to Allen, which is incorporated in its entirety by reference herein. Since skate blades can have different shaped skate bodies, the squaring devices using the skate blade body cannot work precisely on all types of skate blades so that improved skate blade squaring devices are needed for these differently shaped skate blades.

SUMMARY OF THE INVENTION

The present invention is an improvement over prior art skate squaring devices and their methods of use.

One aspect of the invention includes a skate squaring device that interfaces with a skate sharpening fixture for squaring.

The invention also includes a method of determining the squareness of a skate blade edge using the inventive skate squaring device and a skate sharpening fixture.

Other aspects and advantages will become apparent from the following description. One embodiment of the invention includes a skate squaring device comprising a main frame having an elongated shape and a longitudinal axis. The main frame further comprises first and second opposing faces and a third face perpendicular to the first and second opposing faces. A slot is formed in the main frame and it runs perpendicular to the longitudinal axis. Calibration lines are located on each of the first and second opposing faces. The third face uses magnetism to be attached to a skate sharpening fixture. The magnetism can be achieved by associating a magnet with the third face. Alternatively, magnetic material could be incorporated directly as part of the main frame having the third face.

The slot is sized to receive a skate blade body when the third face is magnetically attached to a portion of a skate sharpening fixture. The calibration lines indicate a squareness of an edge of the skate blade when a magnetic angle is magnetically adhered to the edge of the skate blade and rests against one of the first or second opposing faces.

While the main frame can have different configurations, in one embodiment, the main frame is u-shaped, with the first and second faces on opposing first and second legs of the u-shaped main frame and the third face being part of a connector between the first and second legs. The slot is then adjacent to the connector and extends into a portion of the first and second legs. In this embodiment, the connector can include the magnet for adherence between the skate sharpening fixture and the third face and preferably, the magnet is located in a recess in the connector.

While the calibration lines on the opposing faces can be located in different areas, a preferred location is that the calibration lines are located on each end of each of the opposing first and second faces.

One end of the main frame can have a cut-out for accommodating components of the skate sharpening fixture that may interfere with the attachment of the third face to the portion of the skate sharpening fixture.

The inventive skate squaring device can be combined with a magnetic angle to form an assembly for the skate squaring operation. The magnetic angle can be just an angle iron that has a magnet mounted thereon to adhere to the edge of the skate blade.

The invention also entails a method of squaring a skate blade edge by providing the main frame with the slot therein and the squaring calibration lines on opposing first and second faces thereof. The third face of the main frame is magnetically adhered to the surface of the portion of the skate sharpening fixture such that the calibration lines are parallel to the skate sharpening fixture surface and an edge of a skate blade positioned in the slot of the main frame.

The angle is magnetically adhered to the edge of the skate blade with one leg of the angle positioned adjacent to one of the opposing faces of the main frame. A relative position of an edge of the one leg and the calibration lines indicates a squareness of the skate blade edge. Preferably, the third face is attached to an anvil plate of the skate sharpening fixture and the slot is sized to accommodate differently shaped cross sections of the body of the skate blade.

The device and method of using can also include indicia on the main frame to assist a user of the skate sharpening fixture in sharpening the skate. The indicia tells the sharpener how to adjust the skate sharpening fixture, e.g., move the anvil plate up or down, based on a reading of the squareness of the skate blade. The indicia can take on any form, with one example being "UP" with an horizontal arrow beneath it, and "DN" with a horizontal arrow beneath it and pointing in the opposite direction of the arrow associated with "UP."

DESCRIPTION OF THE INVENTION

Figure 1:
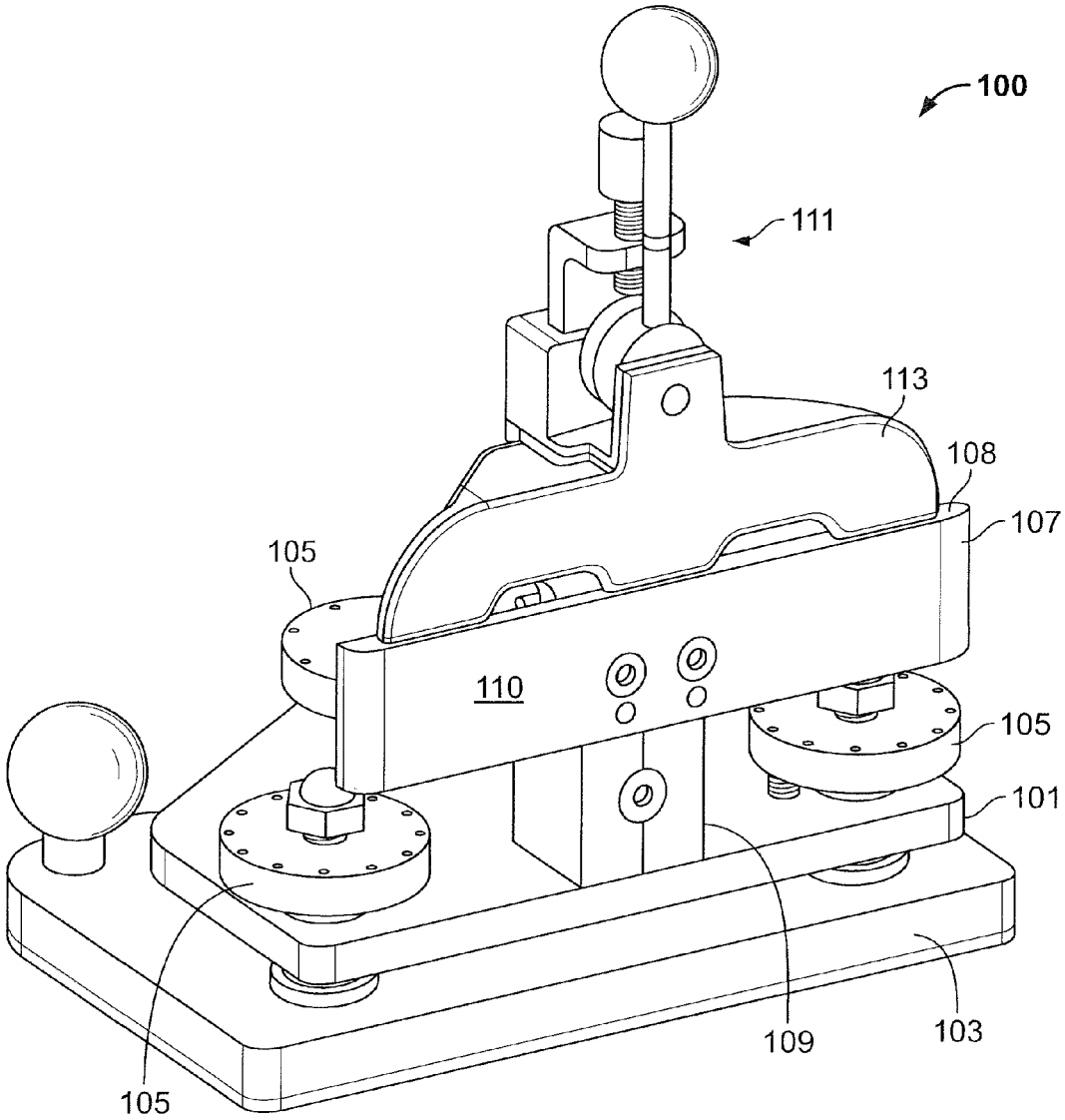
FIG. 1 is a perspective view of a prior art skate sharpening fixture.
Figure 2:
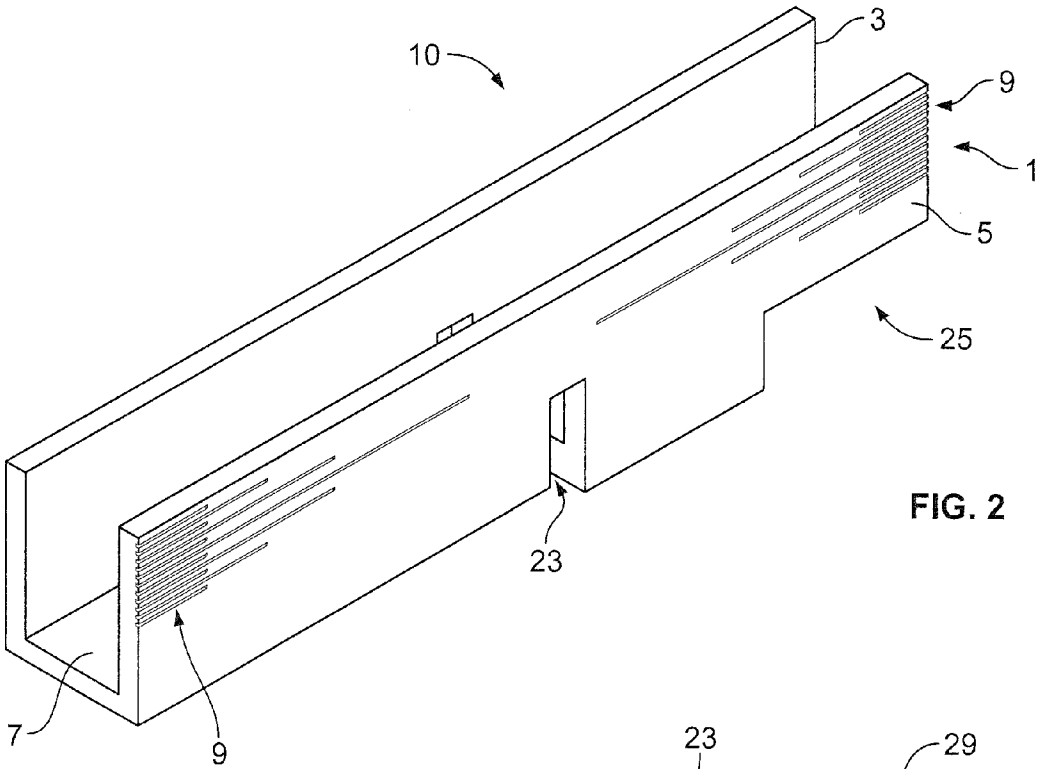
FIG. 2 is a perspective view of one embodiment of the skate squaring device of the invention.
Figure 3:
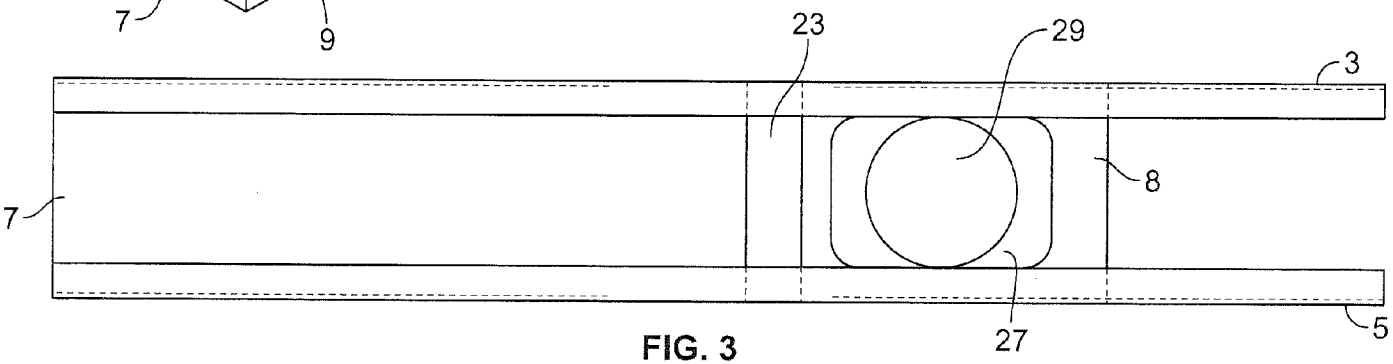
FIG. 3 is top view of the embodiment of FIG. 1.

One embodiment of the skate squaring device of the invention is shown in FIGS. 2-5 The device is generally designated by the reference numeral 10 and includes a main frame 1, which is generally u-shaped. The frame 1 includes opposing legs 3 and 5, which are joined by connectors 7 and 8. Each of the opposing legs 3 and 5 has a set of calibration lines 9. The set of calibration lines 9 are located on each end of each of the legs 3 and 5. The set of calibration lines 9 are made parallel to each other. The lines are also parallel to the face 11 of the connector 8 for squaring of the skate blade edge as described below.

While the calibration lines of the set 9 can have any length or configuration, the length of the lines varies as they extend across the face of each leg. This makes it easier for squaring since different calibration lines will be used for differently-sized skate blades. In the calibration lines shown in FIG. 2, there are four different lengths of calibration lines, 13, 15, 17, and 19. The lines are shown with the shortest lines 13 on the ends of the set with the lines increasing in length towards the center of the set 9. This arrangement of different lengths of lines along the width of the face 21 of each leg 3 and 5 allows different lines to be used in the squaring operation as described below.

The main frame 1 also has a slot 23, which divides the connectors 7 and 8 and extends into each of the legs 3 and 5. The slot is sized big enough so that it can receive any size skate blade, preferably without contacting the blade when it is inserted into the slot.

The main frame 1 can optionally include a cut out portion 25. This cut out portion 25 is designed so that the main frame can be used with all types of skate sharpening fixtures when the skate blade edge is checked for squareness. The cut out portion 25 is made by controlling the length of the connector 8 and the width w1 of the legs 3 and 5. Some skate sharpening fixtures have control knobs positioned below the anvil plate and the cut out portion 25 avoids interference of the knobs when using the skate squaring device.

The main frame uses magnetic attraction to attach to a portion of a skate sharpening fixture. In the embodiment of FIGS. 2-5, the connector 8 includes a recess 27 that is designed to hold a magnet 29. The magnet 29 can be held in the recess 27 using an adhesive, press fit or any other attachment technique to hold it in place. The holding of the magnet can be done in alternative ways as well. For example, the connector 8 could integrally incorporate a magnetic material therein to attach the face 11 thereof to a portion of the skate blade holder.

Figure 4:
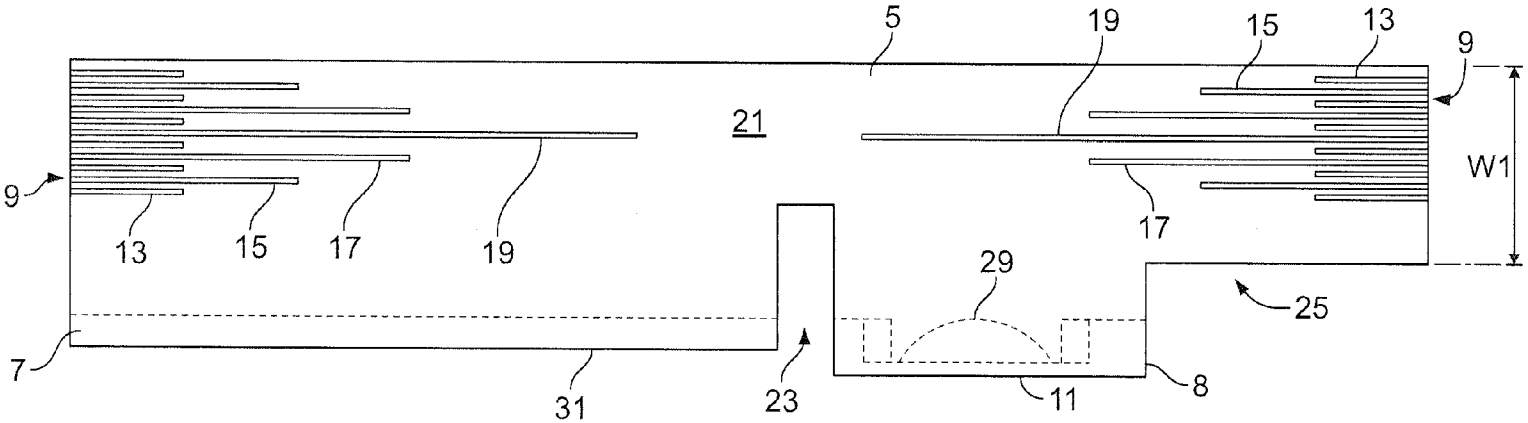
FIG. 4 is a right side elevational view of the embodiment of FIG. 1.
Figure 5:
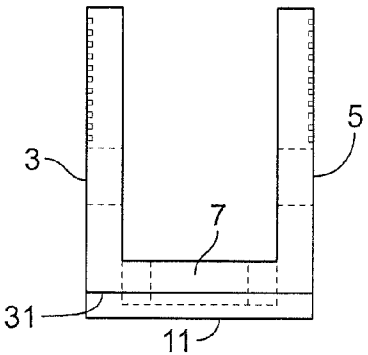
FIG. 5 is an end view of the embodiment of FIG. 1.

Referring to FIG. 4, the width of the legs is controlled so that the squaring face 11 extends beyond the face 31 of the connector 7. Thus, when the squaring face 11 is used with the skate sharpening fixture, the face 31 does not interfere with the squaring process.

Figure 6:
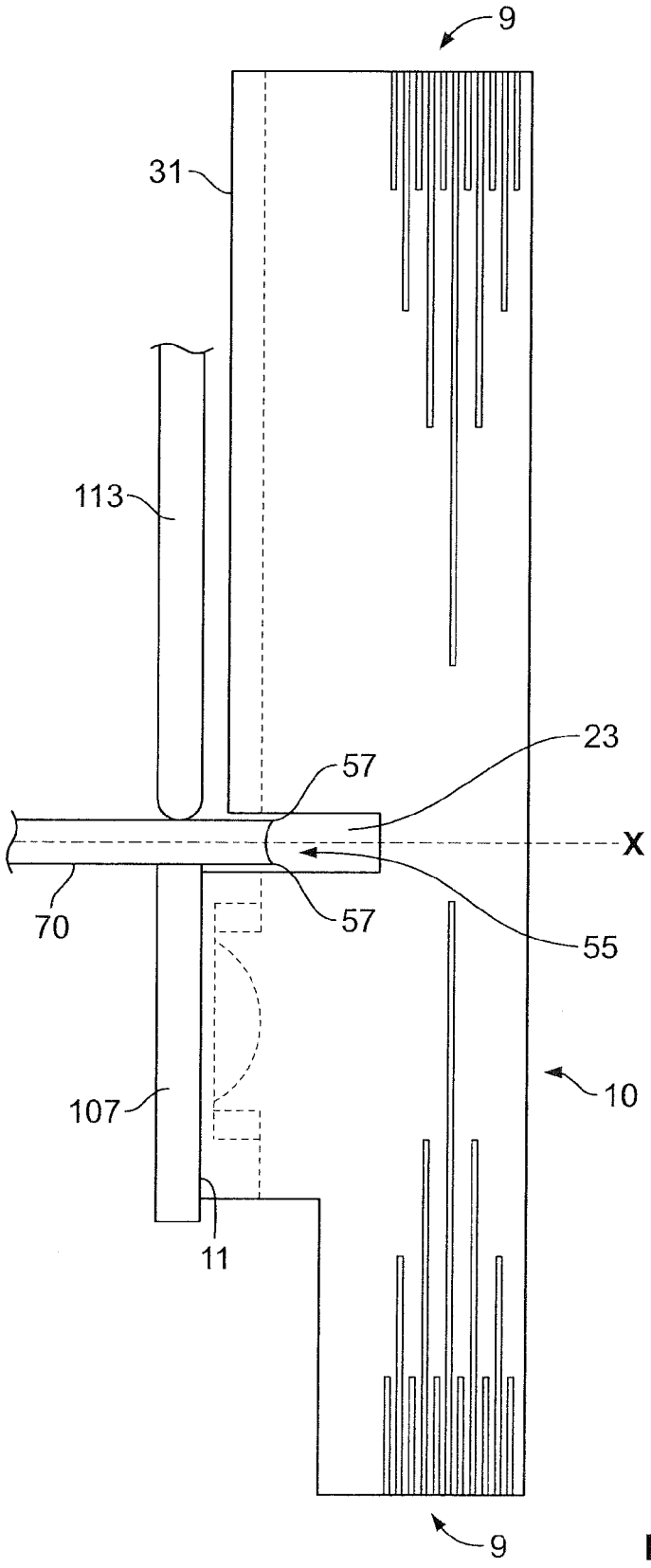
FIG. 6 shows a schematic view an exemplary use of the skate squaring device with a skate sharpening fixture.
Figure 7:
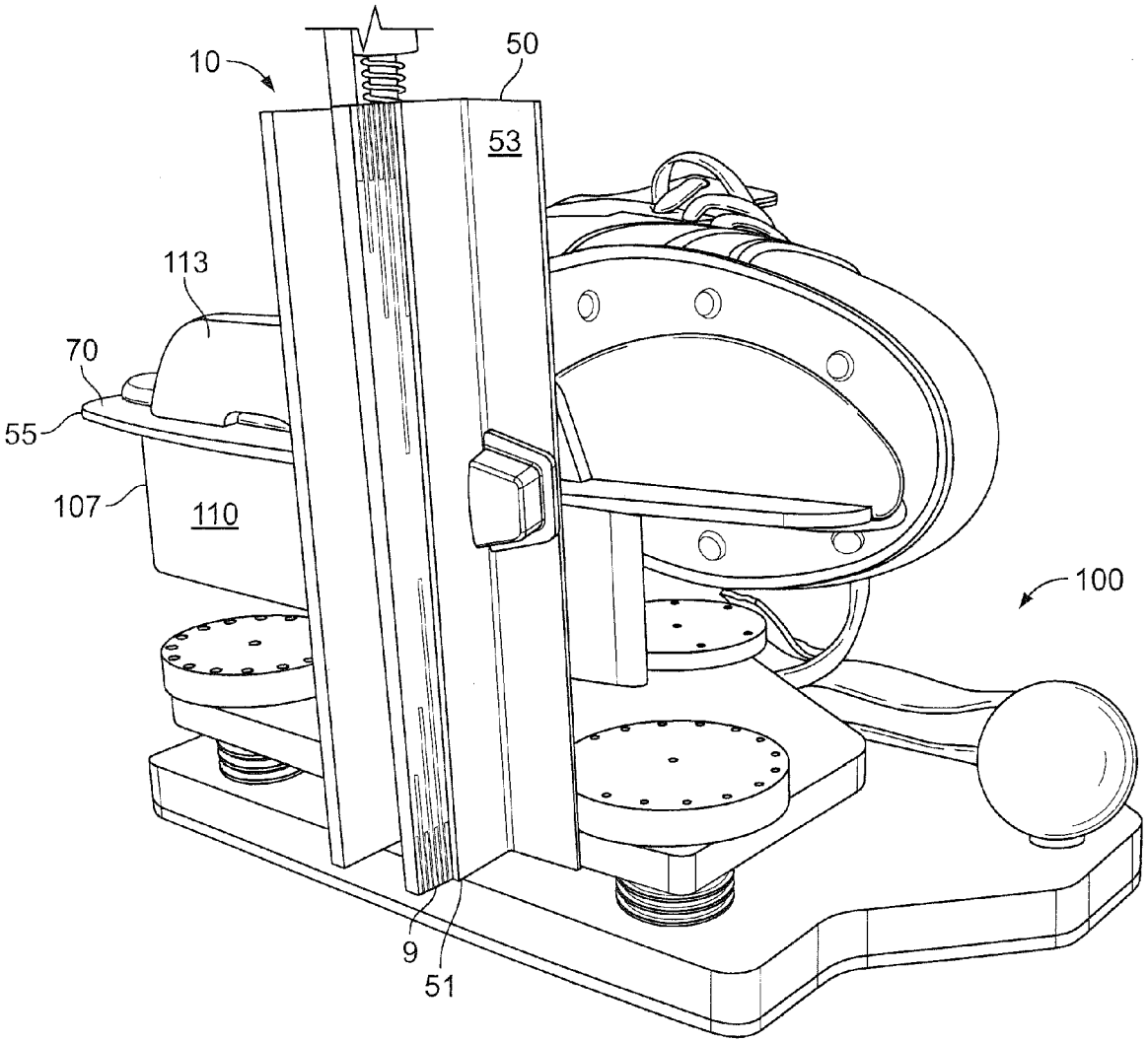
FIG. 7 shows a perspective view of the skate squaring device in use with a skate squaring angle.

FIGS. 6 and 7 show an exemplary use of the skate squaring device with the skate sharpening fixture of FIG. 1 and the magnetic angle used in the Allen patent, which is depicted as 50 in FIG. 7. The fixture 100 is configured so that the face 11 is magnetically attached to the anvil plate 107 of the skate sharpening fixture 100. Since the face 11 is designed to be attached to the anvil plate 107, the face 31 is configured so that it does not contact the clamp of the skate sharpening fixture.

The skate blade body 70 is shown clamped between the anvil plate 107 and the clamp 113. The slot 23 of the squaring device 10 receives the skate blade and the face 11 rests against the anvil plate 107. Since a surface 110 of the anvil plate 107 is perpendicular to a center plane X of the skate blade body, and parallel to a true edge of the skate blade, the squareness of the skate blade edge can be determined. This determination is made by taking a magnetic angle 50, such as disclosed in the Allen patent and magnetically adhering it to the skate blade end 55 as shown in FIG. 7. Since the edge 51 of the angle is parallel to the face 53 of the angle 50 and the lines of the calibration line set 9 are perpendicular to a longitudinal center plane X of the skate blade body, the alignment of the edge 51 with the calibration lines 9 will tell whether the two edges 57 and 59 of the skate blade end 55 are square. The edges 57 and 59 depict the hollow, which is normally found at the end of a skate blade.

The configuration of the squaring device shown in FIGS. 2-5 is exemplary. For example, the connector 7 and face 31, which is not designed for contact with the skate sharpening fixture, could be removed so that the only component linking the two legs 3 and 5 would be the connector 8 and its squaring face 11. The configuration of the legs can also be varied as long as the squaring face 11 remains and sufficient surface is provided on each leg to show the set of calibration lines. While the main frame is shown to be u-shaped, it could also be in block construction so that the space between the legs would be solid but for the slot. With a solid main frame construction, a recess could still be employed to hold the magnet for the squaring face 11 and the recess could be accessed from a side face of the main frame or a face opposite the squaring face 11.

Since the main frame relies on a magnetic attraction between the squaring face and the anvil plate, the main frame should be made of a non-magnetic material, e.g., aluminum or the like. Even a polymer could be used if the polymer is robust enough for repeated squarings.

The particular skate sharpening fixture shown in FIG. 1 is an exemplary one for use with the inventive squaring device. Any skate sharpening fixture that is designed to hold a skate blade for skate sharpening and has a surface that is or can be made vertical so that the longitudinal plane of the skate blade body is perpendicular thereto for squaring purposes can be used.

The squaring operation can take place before the skate sharpening operation begins or can be done during the operation and/or at the end thereof.

The comparison of the edge of the magnetic angle with the calibration lines is the same procedure that is done in the Allen patent. The difference here is that, in Allen, the frame of the device mounts to the skate blade body. According to the invention, the main frame via the face 11 mounts to the skate sharpening fixture and in the preferred embodiment, the anvil plate of the skate sharpening fixture.

This arrangement provides significant advantages over the system of the Allen patent. In Allen, a surface of the skate blade body used for squaring was parallel to a longitudinal centerline plane of the skate blade body. Thus, this surface could be used for the squaring operation since it would be perpendicular to a true and square skate edge. However, the advent of skate blade bodies of different cross sectional shapes, e.g., non-flat surfaces, made it difficult to use the Allen device for squareness checking in these types of skate blades. Since the skate blade body is not used for mounting of the main frame and only fits in the slot 23, the shape of the skate blade body does not matter for squaring. Virtually any skate, no matter what the shape of the skate blade body, can be squared using the inventive device. This is because the slot is sized to receive the skate blade regardless of its cross sectional shape and the device uses the fact that a surface of the skate sharpening fixture, e.g., the anvil plate, is perpendicular to the longitudinal planar axis of the skate blade body for squaring purposes.

Another significant advantage is that the main frame is ambidextrous for the squaring operation. That is, either of the legs of the main frame can be used with the magnetic angle for squaring. So, a right handed person would find it easier to place the magnetic angle on the right side of the main frame as shown in FIG. 7 (right when viewing the skate blade edge mounted in the holder). Likewise, a left handed person would find it easier to place the magnetic angle on the left side of the main frame when it is secured to the anvil. Here, the magnetic angle would be used on the opposite side of the main frame as shown in FIG. 7.

The device and its method of use can also employ indicia on the main frame or elsewhere to help a user of the skate sharpening fixture when sharpening a skate blade. In a typical skate sharpening fixtures, the control knobs in the front raise or lower the anvil plate. In order to square a skate blade, these knobs are rotated to move the skate blade with respect to the skate sharpening grinding wheel. Moving the skate blade down grinds down the upper edge of the skate; moving the skate blade up grinds down the lower edge of the skate.

In one mode of the invention, the surfaces of the main frame having the calibration lines can include indicia to tell the sharpener to move the skate blade up or down depending on the out-of-squareness of the skate blade. If the magnetic angle and calibration lines show that the upper edge of the skate blade needs to be ground down, indicia such as "UP" with "←" underneath it can be placed in the vicinity of the calibration lines on the upper part of the main frame. Similarly, if the lower edge needs to be ground down, indicia such as "DN" with "→" underneath it can be employed and situated in the vicinity of the calibration lines in the lower part of the main frame. This indicia, in whatever form it takes, can reside permanently on the main frame or be printed on adhesive stickers or the like and attached to the main frame, as needed. The indicia should be located such that the angle does not cover it when the angle is in use.

The indicia described above is only an example of indicia and virtually any indicia that would assist the sharpener in moving the skate blade using the fixture for sharpening can be used. While just one word and an arrow is exemplified, more instruction could be provided, e.g., providing more explanation with respect to the location/orientation of the magnetic angle and the movement of the skate blade. The indicia could also be located on the magnetic angle or even the skate sharpening fixture if so desired.

As such, an invention has been disclosed in terms of preferred embodiments thereof which fulfills each and every one of the objects of the present invention as set forth above and provides a new and improved method and device for sharpening skate blades.

Of course, various changes, modifications and alterations from the teachings of the present invention may be contemplated by those skilled in the art without departing from the intended spirit and scope thereof. It is intended that the present invention only be limited by the terms of the appended claims.

We claim:

1. A skate squaring device comprising:

a) a main frame having an elongated shape and a longitudinal axis; the main frame further comprising first and second opposing faces and a third face perpendicular to the first and second opposing faces, the main frame including a slot running perpendicular to the longitudinal axis;

b) calibration lines on each of the first and second opposing faces; and c) wherein the third face includes a magnetic portion, the slot sized to receive a skate blade when the third face is magnetically attached to a portion of a skate sharpening fixture, the calibration lines indicating a squareness of an edge of the skate blade when a magnetic angle is magnetically adhered to the edge of the skate blade and rests against one of the first or second opposing faces.

2. The device of claim 1, wherein the magnetic portion is a magnet positioned near the third face.

3. The device of claim 1, wherein the main frame is u-shaped, with the first and second faces on opposing first and second legs of the u-shaped main frame, respectively, and the third face being part of a connector between the first and second legs, the slot adjacent in the connector and extending into a portion of the first and second legs.

4. The device of claim 3, wherein the connector includes a magnet attached thereto.

5. The device of claim 4, wherein the magnet is located in a recess in the connector.

6. The device of claim 1, wherein the calibration lines are located on each end of each of the opposing first and second faces.

7. The device of claim 1, wherein one end of the main frame has a cut-out for accommodating components of the skate sharpening fixture.

8. A skate squaring device assembly comprising a magnetic angle and the skate squaring device of claim 1.

9. The skate squaring assembly of claim 8, wherein the magnetic angle includes a magnet attached thereto.

10. A method of squaring a skate blade edge comprising:

a) providing a main frame having a slot therein and squaring calibration lines on opposing first and second faces thereof;

b) attaching a third face of the main frame to a surface of a portion of a skate sharpening fixture such that the calibration lines are parallel to the surface and an edge of a skate blade is positioned in the slot of the main frame;

c) magnetically securing an angle to the edge of the skate blade with one leg of the angle adjacent one of the opposing faces, a position of an edge of the one leg and the calibration lines indicating a squareness of the skate blade edge.

11. The method of claim 10, wherein the third face is attached to an anvil plate of the skate sharpening fixture.

12. The method of claim 10, wherein a magnet is used with the third face for attachment to the skate sharpening fixture.

13. The method of claim 10, wherein the main frame is provided with a cut out to accommodate components of the skate sharpening fixture.

14. The method of claim 10, wherein the slot is sized to accommodate skate blade bodies with different cross sectional shapes.

15. The method of claim 10, wherein indicia are located on the main frame and the indicia are used to adjust the skate sharpening fixture for sharpening the skate blade.

16. The device of claim 1, further comprising one or more indicia on the surface of the main frame, the indicia indicating how to adjust the skate sharpening fixture for sharpening of the skate blade.

* * * * *